United States Patent [19]

Hansen et al.

[11] 3,969,690

[45] July 13, 1976

[54] RADIO FREQUENCY SWITCH

[75] Inventors: Russell W. Hansen, Stoughton; Matthew Fassett, Billerica, both of Mass.

[73] Assignee: Raytheon Company, Lexington, Mass.

[22] Filed: Mar. 3, 1975

[21] Appl. No.: 554,851

[52] U.S. Cl. ..... 333/7 R; 333/84 M

[51] Int. Cl.[2] ..... H01P 1/10

[58] Field of Search ..... 333/7 R, 7 D, 84 M, 333/97 S

[56] References Cited

UNITED STATES PATENTS

| | | | |
|---|---|---|---|
| 2,745,917 | 5/1956 | Gates | 333/97 S UX |
| 2,773,242 | 12/1956 | Grieg | 333/97 S X |
| 2,866,167 | 12/1958 | Seidet | 333/84 M UX |
| 3,028,563 | 4/1962 | Morrison | 333/7 R |
| 3,864,536 | 2/1975 | Vaughan et al. | 333/7 R X |

*Primary Examiner*—Paul L. Gensler
*Attorney, Agent, or Firm*—Richard M. Sharkansky; Philip J. McFarland; Joseph D. Pannone

[57] ABSTRACT

A radio frequency switch adapted for operation with radio frequency signals having frequencies above 1,000 MHz is disclosed wherein a pair of strip conductors is disposed in a dielectric between a pair of ground planes, one of such strip conductors being separated from and rotatable with respect to the other one of such strip conductors. The pair of strip conductors is dimensioned to overlap when engaged to effectuate a TEM mode coupling between pairs of ports thereof. Detent means are included to provide an indication when the pair of strip conductors is properly engaged.

1 Claim, 4 Drawing Figures

RADIO FREQUENCY SWITCH

BACKGROUND OF THE INVENTION

This invention relates generally to radio frequency 1.030 switches adapted for coupling one port thereof to a selected one of a pair of ports thereof and more particularly to switches of such type operative at radio frequencies above 1,000 megahertz (MHz).

As is known in the art, it is frequently desirable to transfer power from one electrical circuit to a selected one of a plurality of electrical circuits. Such a power transfer may be accomplished using various types of switches. One such type of switch for providing such power transfer relies on the "making and breaking" of mechanical contacts for its operation. Such switches may operate satisfactorily at radio frequencies greater than 1,000 MHz, but, over a period of time, tend to have their contacts wear, resulting in faulty or intermittent operation.

A second type of switch which avoids the "making and breaking" of mechanical contacts is a so-called "capacitively coupled" switch. While such type of switch has been found satisfactory when operating at radio frequencies less than 1,000 MHz, such switches become impractical when required to operate at higher frequencies because of their extremely small size and relatively high cost. Further, at such higher frequencies it is generally critical that the impedance provided by the switch to the power, as such power passes from an input port to an output port, be uniform in order to assure that maximum power is transferred from the input port to the output port. With a "capacitively coupled" switch it is generally difficult to obtain this desired impedance characteristic, especially where it is desired that the switch have at least an octave operating bandwidth.

As is further known in the art, radio frequency energy having frequencies greater than 1,000 MHz may be coupled between a pair of transmission lines using offset parallel coupled strip transmission lines as described in the article by J. Paul Shelton, Jr. entitled "Impedance of Offset Parallel-Coupled Strip Transmission Lines" published Jan. 1966 in IEEE Transactions on Microwave Theory and Techniques, Vol. MTT-14, No. 1. With such coupling technique two strip conductors, of proper design, disposed in a dielectric between a pair of ground planes, will effectuate the desired maximum power transfer, over an octave bandwidth, when the strip conductors are oriented precisely (to an accuracy in the order of $\lambda/200$, where $\lambda$ is the wavelength of the normal operating frequency of the coupler) with each other. While such an "offset" coupler has been found effective when the strip conductors are fixed in their relative position, the technique of offset coupling has, heretofore, not been extended to switches where the strip conductors are required to move one with respect to the other because of the difficulty in obtaining the precise orientation required of the strip conductors as mentioned above.

SUMMARY OF THE INVENTION

With this background of the invention in mind, it is an object of this invention to provide an improved radio frequency switch adapted for coupling one port thereof to a selected one of a plurality of other ports thereof, such switch being adapted to operate with radio frequency signals having frequencies above 1,000 MHz, such switch having an operating bandwidth in the order of an octave wide or greater.

This and other objects are attained generally by providing a radio frequency switch having a ground plane, a dielectric having a strip conductor disposed therein, the strip conductor being separated from the ground plane to support a TEM mode of energy propagation, a second strip conductor disposed in the dielectric and separated from the first-mentioned strip conductor and rotatable with respect to such first-mentioned strip conductor, such first-mentioned strip conductor and second strip conductor being dimensioned to enable such strip conductors to overlap when engaged to effectuate a coupling between a pair of ports and detent means operative to provide an indication of when the first-mentioned strip conductor and the second strip conductor are so engaged.

BRIEF DESCRIPTION OF THE DRAWINGS

For a more complete understanding of the concepts of this invention reference is now made to the following description of an embodiment of the invention illustrated in the accompanying drawings, in which.

DESCRIPTION OF THE PREFERRED EMBODIMENT

Figures 1, 2, 3, 4:
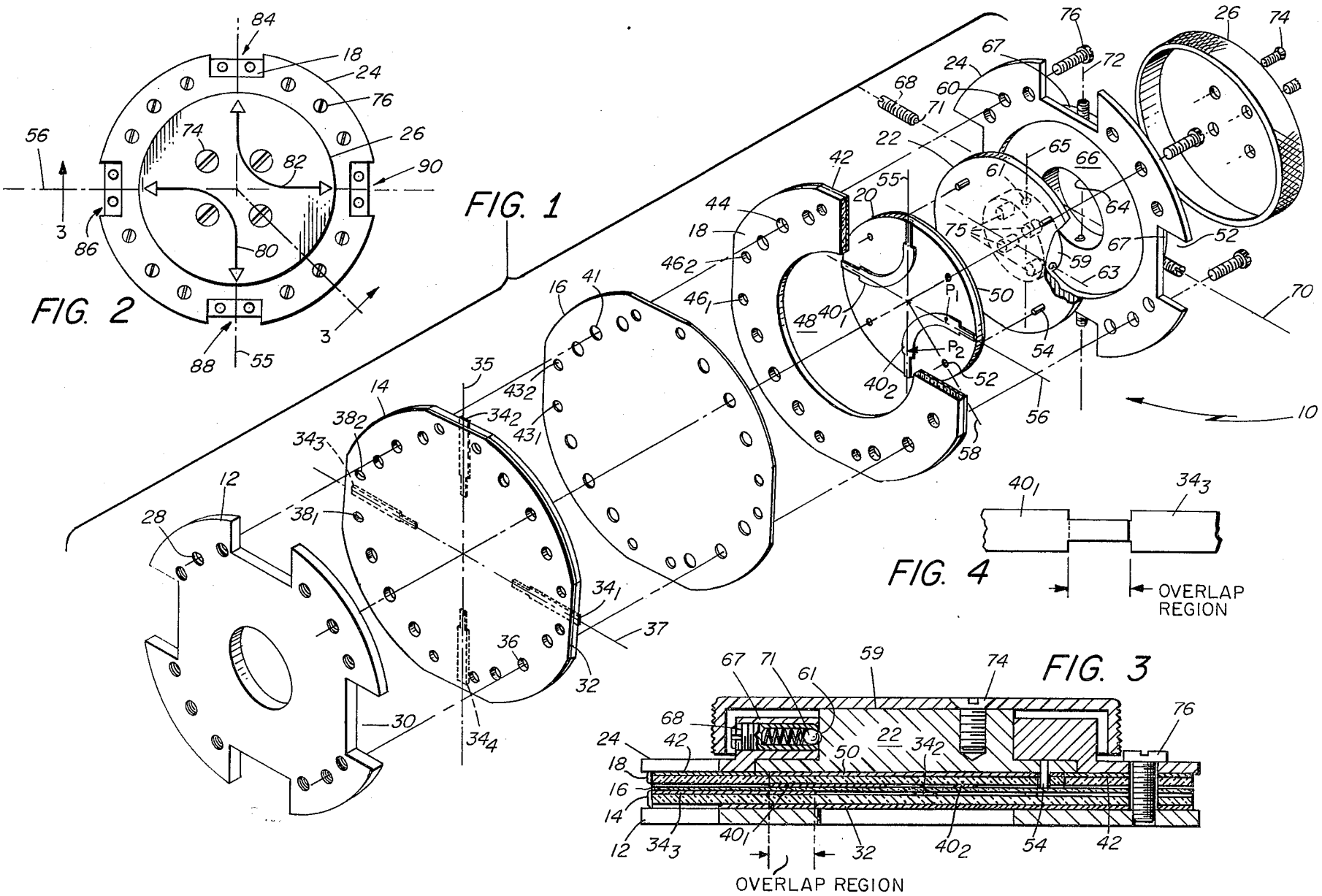
FIG. 1 is an exploded view showing the various elements of a radio frequency switch according to the invention, several of the elements thereof being partially broken away or shown in cross-section.
FIG. 2 is a top view of the radio frequency switch shown in FIG. 1.
FIG. 3 is a cross-sectional view of such radio frequency switch, such cross-section being taken along line 3—3 shown in FIG. 2.
FIG. 4 is a sketch showing the relationship between a pair of strip conductors used in the radio frequency switch when such strip conductors are engaged to effectuate coupling between a pair of ports of the radio frequency switch.

Referring now to FIG. 1, the radio frequency switch 10, here having a nominal operating frequency of 10,000 MHz, is shown to include a back cover 12, a first board 14, a separator 16, a second board 18, a disk 20, a disk holder 22, a front cover 24 and a knob 26.

The back cover 12 here is of any suitable metal, such as aluminum, here having twelve tapped and threaded holes 28 formed therein as shown. The back cover 12 also has four slots 30 formed therein to enable such radio frequency switch 10 to be coupled to four conventional coaxial to stripline connectors, not shown. The radius from the center of the back cover 12 to the center of any one of the twelve holes 28 here is one inch.

The first board 14 is made of dielectric material, here a glass loaded Teflon material called 5880 Duroid, Rogers Corporation, Rogers, Connecticut, having a dielectric constant $\epsilon_r = 2.21 \pm 0.04$. The board 14 has copper clad on one side thereof to form a ground plane 32. On the other side thereof four identical strip conductors $\mathbf{34_1}$ to $\mathbf{34_4}$ are formed along orthogonal axes 35, 37, using any conventional etching process. The thickness of the board 14 here is in the order of 0.045 inches. An exemplary one of the strip conductors, here strip conductor $\mathbf{34_1}$, is shown to have a wide portion and a narrow portion. The wide portion of the strip conductor $\mathbf{34_1}$ here has a width of 0.080 inches and the narrow portion here has a width of 0.045 inches. The length of the narrow portion here is 0.160 inches and the length of the wide portion here is 0.485 inches. Opposing strip conductors, i.e. strip conductors $34_2$ and $34_4$ or strip conductors $34_1$ and $34_3$, have their narrow portions separated here by 1.030 inches. Twelve holes 36 are formed in the board 14 and are aligned with the 12 holes 28 formed in the back cover 12. In addition to the 12 holes 36 the first board 14 has four pairs of holes $38_1$–$38_2$ formed on each side of the strip conductors $34_1$–$34_4$ as shown. These four pairs of holes $38_1$–$38_2$ are used for effectuating a connection between the radio frequency switch 10 and a conventional coax-to-stripline connector (not shown).

Separator 16 here is a sheet of 5880 Duroid material mentioned above having a thickness of 0.0076 inches. As will become apparent, such separator 16 is used to prevent direct contact between the strip conductors $34_1$–$34_4$ and the strip conductors $40_1$ and $40_2$ formed on the disk 20 as will be described. Separator 16 includes 12 holes 41, such holes being aligned with the 12 holes 28 formed in the back cover 12 and the 12 holes 36 formed in the first board 14. In addition to the 12 holes 41 the separator 16 has four pairs of holes $43_1$–$43_2$ formed therein at positions in alignment with the four pairs of holes $38_1$–$38_2$ formed in the first board 14.

The second board 18 here is made of the same material as the first board 14. Like such first board 14 the second board 18 has copper 42 clad on one side thereof, 12 holes 44 formed therein and aligned with the 12 holes 36 of the first board 14 and four pairs of holes $46_1$–$46_2$ formed therein and aligned with the corresponding four pairs of holes $38_1$–$38_2$ formed in such first board 14. These four pairs of holes $46_1$–$46_2$ are to effectuate connection between a conventional coaxial-to-stripline connector (not shown). The second board 18 has a hole 48 formed in the central portion thereof. Such hole 48 is used to receive the disk 20.

Disk 20 is made of a dielectric material, here the same as the dielectric material used in the first and second boards 14, 18.

Copper 50 is clad on one side of such disk 20 and on the other side thereof a pair of strip conductors $40_1$ and $40_2$ are formed using any conventional etching process. The thickness of the disk is equal to the thickness of the second board 18, here 0.045 inches, and the diameter of the disk 20 is slightly smaller than the hole 48 (here the diameter of the disk 20 is 1.3500 inches) so as to enable such disk 20 to be inserted into such hole 48 and also to allow such disk 20 to rotate within such hole 48 of the second board 18. Further, it should be noted that the copper 42 of the second board 18 and the copper 50 of the disk 20 form a ground plane when such disk is inserted into hole 48. This is shown in FIG. 3. The disk 20 has four holes 52 drilled therethrough to enable such disk 20 to be held by four pins 54. Such pins 54 are affixed to disk holder 22 by any convenient means, such as a press fit. Here such four pins 54 form a press fit with the disk 20 thereby to hold such disk 20. The strip conductors $40_1$ and $40_2$ are each identical in construction and an exemplary one thereof, here strip conductor $40_2$, is shown to have two narrow end portions, each one here 0.160 inches in length, and a central wider portion. The width of the narrow portions here is 0.045 inches and the width of the wide portion is 0.080 inches. The end portions of the strip conductor $40_2$ are disposed along orthogonal lines 55, 56. Such orthogonal lines 55, 56 intersect at the center of the disk 20. One of the four holes 52 is disposed along line 58, such line 58 being at an angle 45° with respect to the lines 55, 56. The distance from the center of the disk 20 to the center of the hole 52 disposed along line 58 is 0.5656 inches. The central portion of the strip conductor $40_2$ is disposed along the arc of a circle having its center at the center of the just-mentioned hole 52 and having a radius here of 0.40 inches. The arc becomes tangent to the lines 55, 56 at points $P_1$, $P_2$. The distance between the point $P_1$ and the end of the strip conductor $40_2$ closest to such point $P_1$ is 0.275 inches and likewise the distance between point $P_2$ and the end of the strip conductor $40_2$ closest to such point $P_2$ is also 0.275 inches.

Disk holder 22 here is of any suitable metal, here aluminum. The disk holder 22 is formed by using any conventional machining process to have a cap 59 formed on the upper portion thereof. Here the diameter of the cap 59 is 0.852 inches. The cap 59 here has a height of 0.301 inches. Four recesses 61 are formed on the sides of the cap 59 as shown. The recesses 61 are spaced regularly about the periphery of the cap 59. The recesses 61 are formed so that when the disk 20 is affixed to the disk holder 22 by means of the pins 54 the four recesses 61 are aligned with the ends of the strip conductors $40_1$, $40_2$. That is, the recesses 61 are disposed along orthogonal lines 63, 65 parallel to lines 55 and 56.

Front cover 24, here is any suitable metal, here aluminum, such as that used for the back cover 12. The front cover 24 has twelve holes 60 drilled therein, such holes being aligned with the twelve holes 28 in such back cover 12. Further, four slots 62 are formed in the front cover 24 and are in alignment with the four slots 30 of the back cover 12. The front cover 24 has a hole 64 formed in the center thereof. The diameter of such hole 64 is slightly larger than the diameter of the cap 59 in order to enable the disk holder 22 to rotate within such hole 64. The front cover 24 has a recessed central portion 66 to enable insertion of the disk holder 22. (See also FIG. 3.) The front cover 24 has four holes drilled in the cap 67 thereof, such holes being threaded to receive four set screws 68. The four holes are drilled in such cap 67 along two orthogonal axes 70, 72. Each one of the set screws 68 has a spring loaded ball 71 (FIG. 3) disposed therein, the end of such screws being formed to capture such balls 71 after their insertion into the screw 68. This is more clearly shown in FIG. 3. The screws 68 are tightened to a desired torque so that an indication is provided when the balls 71 engage the recesses 61.

The knob 26 is hollowed to enable such knob 26 to fit over the cap 67 after the screws 68 have been properly torqued. Such knob 26 here has four holes formed therein to enable flat head screws 74 to screw into the four tapped holes 75 formed in the disk holder 22, back cover 24 and knob 26 together as an integral unit.

The back cover 12 (together with the disk holder 22, knob 26, disk 20 fastened thereto) the first board 14, the separator 16, the second board 18, and the front cover 24 are then fastened together by machine screws 76. Such screws pass through holes 60, 44, 41, 36 to become threaded in holes 28.

Referring now to FIG. 2 it is seen that two arrows 80, 82 are scribed on the top of the cap 26. Such arrows 80, 82 are aligned respectively with strip conductors $40_1$ and $40_2$. Further, it may be seen that the switch 10 has four ports 84-90.

Therefore, when switch 10, after being assembled as described, has knob 26 turned manually the strip conductors $40_1$–$40_2$ rotate with respect to the strip conductors $34_1$–$34_4$. Further, the spring loaded balls 71 and the recesses 61 form a detent to provide an indication when the strip conductors $34_1$–$34_4$ are properly aligned with strip conductors $40_1$, $40_2$ to effectuate couplings between pairs of the ports 84–90. That is, when knob 22 is rotated to the orientation indicated in FIG. 2 couplings are effectuated between ports 84 and 90 and between ports 86 and 88. Likewise, if the knob 92 is rotated clockwise 90° from the orientation indicated in FIG. 2, coupling is effectuated between ports 90 and 88 and between ports 86 and 84. It is now apparent, therefore, that by rotating the knob 22 as just described port 90 may be coupled selectively to either port 84 or port 88 and port 86 may be coupled selectively to either port 88 or port 84.

Further, in either case the desired coupling is effectuated by turning knob 22 until the balls 71 engage the recesses 61, that is until the detent is actuated. When such balls 71 so engage the recesses 61 the strip conductors $40_1$ and $40_2$ are properly oriented with strip conductors $34_1$–$34_4$ to form two offset parallel coupled strip transmission lines thereby insuring maximum power transfer between the coupled ports.

When the balls 71 so engage the recesses 61, that is when the two offset parallel coupled strip transmission lines are formed, the relationship between two overlapping portions of strip conductors, here for example the overlapping portions of strip conductors $40_1$ and $34_3$ are shown in FIGS. 3 and 4. Therefore, energy propagates between coupled ports in the TEM mode. It is here noted that when such strip conductors are in this relationship an overlap region exists (as indicated in FIGS. 3 and 4), such region extending for a length, here 0.16 inches. In this regard it should be noted that when the radio frequency switch 10 is operating in its nominal operating frequency of 10,000 MHz, the effective wavelength of such frequency (that is, the wavelength of such frequency in the dielectric material) is here 0.793 inches. That is, the overlap region has a length in the order of $\lambda/4$.

Having described a preferred embodiment of the invention, other embodiments will now readily occur to those of skill in the art. For example, while a four port switch has been described, the number of ports may be increased. Further, it may be desirable to have an overlap region greater than the length of the narrow end of a strip conductor in order to account for so-called "fringing" effects. That is, the length of the overlap region may be in the order of $\lambda/4$ or greater (where $\lambda$ has been previously defined). Further, it may be desirable to have the two engaged strip conductors offset slightly one from the other in the overlap region rather than positioned directly one on top of the other as shown in FIG. 3. Still further, the switch may be appropriately adjusted for other nominal operating frequencies. It will be understood, therefore, that other changes may be made without departing from the spirit and scope of the appended claims.

What is claimed is:

1. A radio frequency switch for coupling selected ones of a plurality of ports comprising:

a. an outer frame;

b. a first dielectric board, affixed to such outer frame, having a ground plane on one side thereof and a plurality of strip conductors formed on the other side thereof to extend radially inwardly of such board, one end of each one of the plurality of strip conductors being coupled to a corresponding one of the plurality of ports, such ports being disposed about the periphery of such dielectric board;

c. a dielectric sheet having a first surface disposed over the plurality of strip conductors;

d. a frame member, affixed to the outer frame, having an aperture formed through the center portion thereof and a conductive material disposed on one of the planar surfaces thereof, a second planar surface thereof being in contact with a second surface of the dielectric sheet;

e. a disk-shaped dielectric board, disposed within such aperture, having a conductive material disposed on one planar surface thereof, such surface being in a plane with the conductive material of the frame member to form a second ground plane, and at least one strip conductor formed on the other side thereof and in contact with the second surface of the dielectric sheet, such disk-shaped dielectric board being rotatable within the aperture and in a parallel relationship with respect to the first dielectric board, the strip conductors formed on the dielectric boards being separated by the dielectric sheet and being disposed between the ground planes, the strip conductors on both such boards being dimensioned to enable the at least one strip conductor to overlap pairs of the plurality of strip conductors by a length in the order of $\lambda/4$ where $\lambda$ is the effective wavelength of the nominal operating frequency of the switch, thereby to effectuate a coupling between selected pairs of the plurality of strip conductors; and f. detent means for indicating such coupling, such detent means including an engageable pair of elements, one of such pair of elements being affixed to the outer frame and the other one of such pair of elements being affixed to the disk-shaped dielectric board.

* * * * *